US008652595B2

(12) United States Patent
Zeng et al.

(10) Patent No.: US 8,652,595 B2
(45) Date of Patent: Feb. 18, 2014

(54) RECORDING MEDIUM HAVING FIRST SET AND SECOND SET OF POLYMERIC BEADS

(75) Inventors: Xi Zeng, San Diego, CA (US); Tao Chen, San Diego, CA (US); Eric L. Burch, San Diego, CA (US); Xiaoqi Zhou, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 3 days.

(21) Appl. No.: 13/424,129

(22) Filed: Mar. 19, 2012

(65) Prior Publication Data

US 2013/0243979 A1 Sep. 19, 2013

(51) Int. Cl.
*B41M 5/00* (2006.01)
*B41M 5/52* (2006.01)

(52) U.S. Cl.
CPC ..... *B41M 5/5236* (2013.01); *B41M 5/52* (2013.01); *B41M 5/5218* (2013.01); *B41M 5/5254* (2013.01)
USPC ..... 428/32.27; 428/32.28; 428/32.34; 428/32.35

(58) Field of Classification Search
CPC .... B41M 5/5236; B41M 5/52; B41M 5/5218; B41M 5/5254
USPC ..... 428/32.27, 32.28, 32.34, 32.35
See application file for complete search history.

(56) References Cited

U.S. PATENT DOCUMENTS

| | | | | |
|---|---|---|---|---|
| 6,723,397 | B2 | 4/2004 | Wexler | |
| 6,946,240 | B2 | 9/2005 | Rao et al. | |
| 7,655,286 | B2 | 2/2010 | DeMejo et al. | |
| 7,829,161 | B2 | 11/2010 | Wexler et al. | |
| 2003/0059583 | A1 * | 3/2003 | Allan | 428/195 |

* cited by examiner

*Primary Examiner* — Betelhem Shewareged

(57) ABSTRACT

A recording medium includes a base substrate, a fusible layer including a first set of polymeric beads and a second set of polymeric beads, and an ink receiving layer disposed between the base substrate and the fusible layer. The first set of polymeric beads has an average volume-based particle size less than two microns. The second set of polymeric beads has an average volume-based particle size equal to or greater than five microns. The fusible layer includes a weight percent of the second set of polymeric beads of at least three percent.

23 Claims, 2 Drawing Sheets

RECORDING MEDIUM HAVING FIRST SET AND SECOND SET OF POLYMERIC BEADS

BACKGROUND

Recording media such as sheet media and web media may be used to receive ink including pigmented ink and/or dyes to form images thereon. The images may be in a form of photographs, symbols, design, and/or text. The ink may be applied to the recording media by an ink applicator unit.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components, layers, substrates and features illustrated in the figures are chosen primarily for convenience and clarity of presentation and are not necessarily to scale. Referring to the attached figures:

Throughout the drawings, identical reference numbers designate similar, but not necessarily identical, elements.

DETAILED DESCRIPTION

Figure 1:
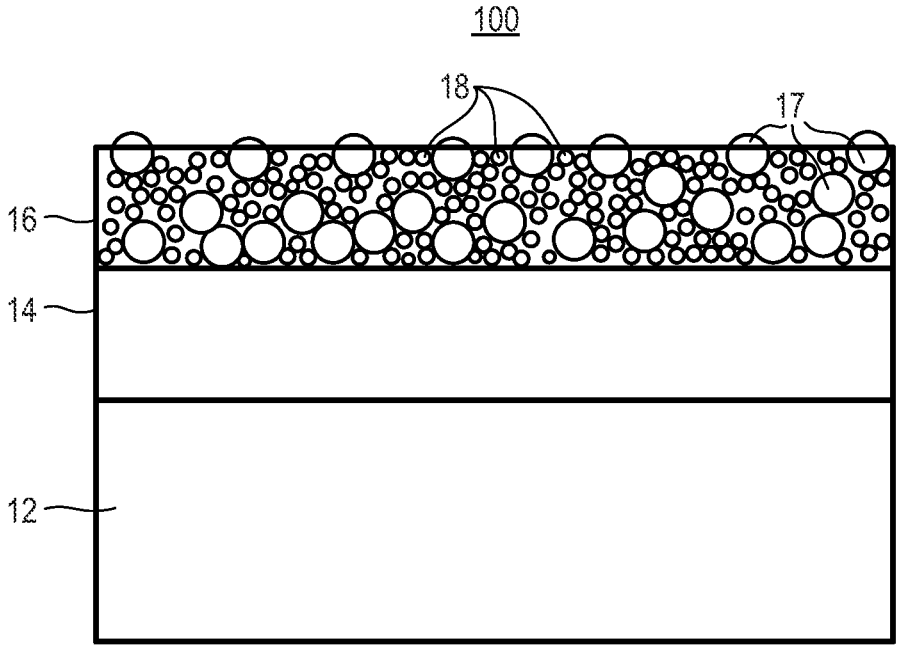
FIG. 1 is a cross-sectional view illustrating a recording medium according to an example.

Recording media such as web media or sheet media may be used to receive ink such as dyes and/or pigmented ink including ink pigments to form images such as photographs, designs, symbols, text, and the like. For example, the recording medium may be an inkjet recording medium. The ink may be in a variety of forms including latex-based inks. The ink may be applied by an ink applicator unit such as an inkjet printhead. For example, an image forming system such as a retail-photo-system may include an inkjet printhead to apply ink including ink pigments to form images such as photographs to a recording medium. The recording medium may be multi-layered. For example, the recording medium may include a base substrate, an ink receiving layer, and a fusible layer to be printed on by ink. That is, a fusible layer is a layer that may keep its original structure under various temperatures and is able to go through a deforming, sintering, or film forming process under conditions such as heat, pressure, and/or microwave, and the like. The fusible layer may include polymeric beads having an average particle size to absorb ink. Such polymeric beads may melt and/or deform after printing when subjected to a post-printing process including the application of pressure and/or heat, and the like, to obtain a glossy and/or smooth image such as a photograph. However, the durability and/or scratch resistance of the post-printing process image may be low. Further, the glossy and/or smooth surface may make scratches more visible and obvious. Consequently, the image may be susceptible to degradation due to external forces such as scratching and abrasive forces being applied to the recording medium.

In examples, a recording medium includes, among other things, a fusible layer including a first set of polymeric beads and a second set of polymeric beads. The first set of polymeric beads includes an average volume-based particle size less than two microns. The second set of polymeric beads includes an average volume-based particle size equal to or greater than five microns. Volume-based particle size (hereinafter "particle size") may correspond to a diameter of a sphere that has a same volume as the respective particle. For example, the respective particle may be the respective polymeric bead. The fusible layer includes a weight percent (wt %) of the second set of polymeric beads of at least three percent. Weight percent, for example, may correspond to the percent by weight of an element in a compound, or the percent by weight of one component in a mixture.

The combination of a second set of polymeric beads significantly greater in size (e.g. at least twice as large) than the first set of polymeric beads contributes to durability of the image, prior to and after, a post-printing process in which the first and second set of polymeric beads are melted and/or deformed. That is, at least a portion of the larger-sized polymeric beads extrudes out and/or creates a barrier to protect the ink and/or ink pigments from being removed and/or altered from the recording medium. That is, at least some of the larger-sized beads extend an outer surface of the fusible layer outward to form bumped features thereto to block, for example, the ink pigments from external forces such as scratching and abrasive forces. Further, the first set of polymeric beads significantly smaller in size than the second set of polymeric beads contribute to proper penetration of the ink into the fusible layer and deformation during post-printing process to enable a glossy and/or smooth image. Accordingly, durability and/or scratch resistance of images formed by the ink may be increased due to its robustness to external forces such as scratches and abrasive forces applied to the recording medium.

FIG. 1 is a cross-sectional view illustrating a recording medium according to an example. Referring to FIG. 1, in some examples, a recording medium 100 includes a base substrate 12, a fusible layer 16, and an ink receiving layer 14 disposed between the base substrate 12 and the fusible layer 16. The fusible layer 16 may include a first set of polymeric beads 18 and a second set of polymeric beads 17. The first set of polymeric beads 18 may have an average particle size less than two microns. The fusible layer 16 may also have a weight percent of the second set of polymeric beads 17 greater than three. That is, a sufficient amount of the second set of polymeric beads 17 should be present so that the density of bumped features 17*a* (FIG. 2) on the outer surface 16*a* (FIG. 2) of the fusible layer 16 is adequate to reduce, for example, ink pigments forming the images to be removed by external forces, scratches, and other defects.

Figure 2:
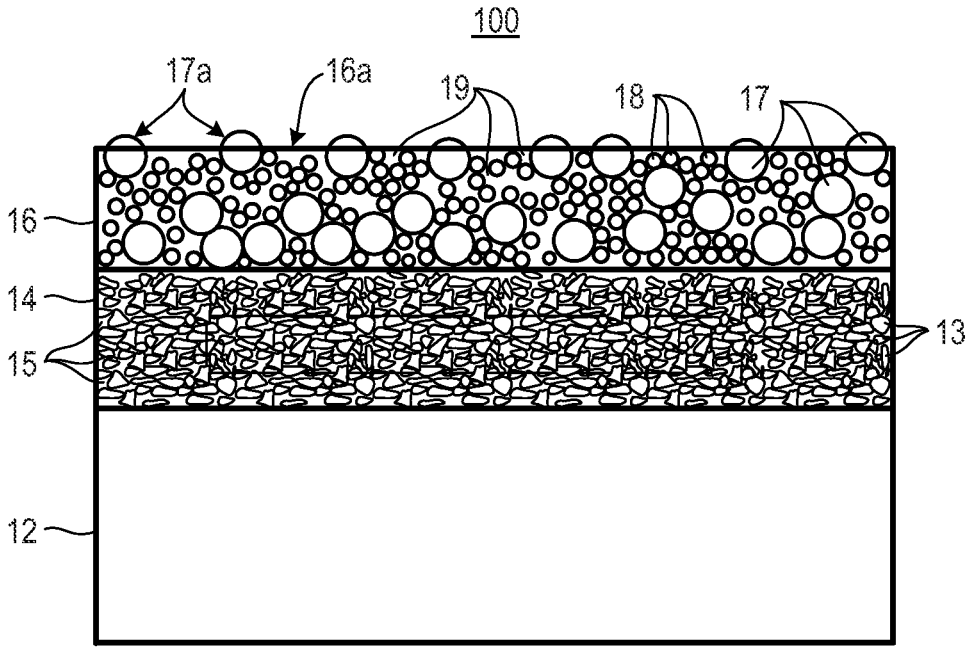
FIG. 2 is a cross-sectional view illustrating the recording medium of FIG. 1 according to an example.

FIG. 2 is a cross-sectional view illustrating the recording medium of FIG. 2 according to an example. Referring to FIG. 2, in some examples, a recording medium 100 includes a base substrate 12, a fusible layer 16, and an ink receiving layer 14 disposed between the base substrate 12 and the fusible layer 16. The fusible layer 16 may include a first set of polymeric beads 18, a second set of polymeric beads 17, and a first binder 19. The first set of polymeric beads 18 may have an average particle size less than two microns. The fusible layer 16 may also have a weight percent of the second set of polymeric beads 17 greater than three. The ink receiving layer 14 may include a first set of pigments 13 and a second binder 15. The ink receiving layer 14 may also be porous, for example, to readily receive ink applied thereto.

In some example, the images on the recording medium 100 may go through a post-printing process in which heat and/or pressure, and the like, is applied to the recording medium 100. During such a post-printing process, the first set of polymeric beads 18 goes through a melting and/or deformation process, for example, to provide high image gloss and/or sheet gloss. Additionally, the second set of polymeric beads 17 may provide scratch resistance and durability for the printed images before and/or after the post-printing process. That is, the large polymeric beads of the second set of polymeric beads 17 may extrude outward to form bumped features 17*a* in the fusible layer 16 and/or provide a barrier in a deformed or non-deformed state to reduce contact by an external force such as scratching and abrasive forces with the printed image. Therefore, ink removal and/or alteration may be reduced.

Base Substrate

Referring to FIGS. 1 and 2, in some examples, the base substrate 12 may include materials which can carry on coating composition, for example, natural materials such as a base comprise of cellulose fibers and synthetic materials such as a base comprise of synthetic polymeric fibers, and non-fabric materials such as a polymeric film, or a mixture of them. The base substrate 12 may also include a polymeric binder. The polymeric binder may be included, for example, when non-cellulose fibers are used. In some examples, the base substrate 12 may include cellulose fibers and synthetic fibers. The cellulose fibers may be made from hardwood or softwood species. The synthetic fibers may be made from polymerization of organic monomers. In some examples, the base substrate 12 may include non-cellulose fibers. The base substrate 12 may be formed with a pilot paper machine with a pulp, and the like.

Alternatively, the base substrate 12 may include a coating layer on top of cellulose fibers and/or synthetic fibers. For example, the coating layer may include at least an inorganic pigment and a binder. Alternatively, the coating layer may include polymeric binders or resins. In some examples, the base substrate 12 may include an extruded polymeric film layer on top of cellulose fibers and/or synthetic fibers, such as photo base or photo paper. Still yet, the base substrate 12 may include polymeric films, with or without a surface treatment or a surface coating layer.

Fusible Layer

Referring to FIGS. 1 and 2, in some examples, the fusible layer 16 may include a first set of polymeric beads 18, a second set of polymeric beads 17, and a first binder 19. In some examples, the fusible layer 16 may also include a surfactant, defoamer, rheology modifier, pH controlling agent, dispersant, and the like. The fusible layer 16 may be in the form of a coating. The fusible layer 16 may be formed by pond coating, Meyer rod coating, blade coating, air-knife coating, curtain coating, and the like.

First Set of Polymeric Beads

The first set of polymeric beads 18 may include an average volume-based particle size less than two microns. The small size of the respective beads of the first set of polymeric beads 18 may produce small pores or channels in the fusible layer 16. These pores or channels may help, for example, a liquid portion of ink, (e.g. ink vehicles) to be quickly absorbed into the ink-receiving layer 14. Thus, image quality may not be negatively impacted by the fusible layer 16. The relatively small particle size of the first set of polymeric beads 18 may facilitate the fusible layer 16 to provide a smooth and/or glossy surface in a post-printing process. In some examples, the average volume-based particle size of the first set of polymeric beads 18 may be less than one micron. Additionally, the average volume-based particle size of the first set of polymeric beads 18 may be less than half a micron.

The first set of polymeric beads 18 may include a synthetic polymer and/or a natural polymer. The synthetic polymer may include at least one of polyethylene, polypropylene, paraffin, polybutadiene, polyurethane, epoxy resin, silicone resin, polyamide resin, styrene, styrene butadiene, styrene acrylate, styrene acrylic, ester, acrylic, acrylate, methylacrylate, vinyl ester, vinyl ether, and vinyl ketone. The natural polymer may include at least one of a natural wax, gelatin, gelatin derivative, cellulose, cellulose derivative, starch, and starch derivative. In some examples, the first set of polymeric beads 18 may be in a dispersion form and/or a latex form.

In some examples, the first set of polymeric beads 18 may have a glass transition temperature in a range of fifty ° C. to two hundred fifty ° C. For example, the glass transition temperature (Tg) of a non-crystalline material may correspond to the critical temperature at which the material changes its behavior from being glassy (e.g., hard and brittle) to being rubbery (e.g., elastic and flexible). In some examples, the glass transition temperature may be in a range of seventy ° C. to two hundred ° C. Additionally, in some examples, the glass transition temperature may be in a range of eighty ° C. to one hundred fifty ° C. For example, the first set of polymeric beads 18 may have a high glass transition temperature to enable the first set of polymeric beads 18 to maintain respective individual shapes, for example, during the manufacturing of the recording medium 100 and receiving of ink to maintain porosity. As a result, ink vehicle or solvents can pass through the pores in this layer and generate good quality images. Additionally, the glass transition temperature may also enable the first set of polymeric beads 18 of the fusible layer 16 to melt and/or deform in the post-printing process to form a smooth and/or glossy layer. Thus, the image may have a glossy, smooth, and/or reflective appearance. In some examples, the post-printing process temperature to be applied to the fusible layer 16 may be at least ten ° C. greater than the glass transition temperature of the first set of polymeric beads 18.

In some examples, the first set of polymeric beads 18 may have a spherical shape and a diameter corresponding to the volume-based particle size. Alternatively, the first set of polymeric beads 18 may include shapes other than a spherical shape, including irregular shapes. In some examples, the first set of polymeric beads 18 may include solid beads. Alternatively, the first set of polymeric beads 18 may include hollow beads. In some examples, the amount of the first set of polymeric beads 18 exceeds the amount of the second set of polymeric beads 17 in the fusible layer 16. That is, a sufficient amount of the first set of polymeric beads 18 should be present in the fusible layer 16 to enable a glossy and/or smooth surface after a post-printing process. For example, the amount of the first set of polymeric beads 18 may significantly exceed the amount of the second set of polymeric beads by more than 200%.

Second Set of Polymeric Beads

The second set of polymeric beads 17 may include an average volume-based particle size equal to or greater than five microns. The second set of polymeric beads 17 may include a synthetic polymer and/or a natural polymer. The synthetic polymer may include at least one of polyethylene, polypropylene, paraffin, polybutadiene, polyurethane, epoxy resin, silicone resin, polyamide resin, styrene, styrene butadiene, styrene acrylate, styrene acrylic, ester, acrylic, acrylate, methylacrylate, vinyl ester, vinyl ether, and vinyl ketone. The natural polymer may include at least one of a natural wax, gelatin, gelatin derivative, cellulose, cellulose derivative, starch, and starch derivative. In some examples, the average volume-based particle size of the second set of polymeric beads 17 may be greater than eight microns. In some examples, the second set of polymeric beads 17 may be in a dispersion form and/or a latex form. Additionally, the average volume-based particle size of the second set of polymeric beads 17 may be greater than ten microns.

In some examples, the second set of polymeric beads 17 may have a glass transition temperature in a range of fifty ° C. to two hundred fifty ° C. In some examples, the glass transition temperature may be in a range of seventy ° C. to two hundred ° C. Additionally, in some examples, the glass transition temperature may be in a range of eighty ° C. to one hundred fifty ° C. For example, the second set of polymeric beads 17 may have a high glass transition temperature to enable the second set of polymeric beads 17 to maintain respective individual shapes, for example, during the manufacturing of the recording medium 100 and receiving of ink to maintain porosity. As a result, ink vehicle or solvents can pass through the pores in this layer and generate good quality images. Additionally, the glass transition temperature may also enable the second set of polymeric beads 18 of the fusible layer 16 to melt and/or deform in the post-printing process while providing a barrier to reduce contact of the ink by external forces such as scratching and abrasive forces. In some examples, the post-printing process temperature to be applied to the fusible layer 16 may be at least ten ° C. greater than the glass transition temperature of the second set of polymeric beads 17.

In some examples, the second set of polymeric beads 17 may have a spherical shape and a diameter corresponding to the volume-based particle size. Alternatively, the second set of polymeric beads 17 may include shapes other than a spherical shape, including irregular shapes. In some examples, the second set of polymeric beads 17 may include solid beads. Alternatively, the first set of polymeric beads 17 may include hollow beads.

First Binder

The first binder 19 may include at least one of polyvinyl alcohol, polyvinyl alcohol derivative, polyethylene glycol, polyethylene glycol derivative, polyurethane, polyvinylpyrrolidone, starch, starch derivative, gelatin, gelatin derivative, cellulose, cellulose derivative, maleic anhydride polymer, maleic anhydride copolymer, acrylic ester polymer, acrylic ester copolymer, polymethylacrylate, polymethylacrylate copolymer, polyacrylamide, and latex resin. The latex resin may be based on at least one of a polymer and a copolymer of styrene butadiene, acrylic, styrene acrylic, styrene methylacrylate, styrene acrylonitrile, styrene maleic anhydride, vinyl acrylic, vinyl acetate, vinyl ester, and vinyl ether. The first binder 19 may provide adhesion between the respective polymeric beads 18 and 17. For example, the first binder 19 may also support the larger second set of polymeric beads 17 to extrude outward from the outer surface 17*a* of the fusible layer 16 to form bumped features 16*a* to facilitate durability of the printed image. The first binder 19 may also provide adhesion between the fusible layer 16 and ink receiving layer 14.

Ink Receiving Layer

Referring to FIGS. 1 and 2, in some examples, the ink receiving layer 14 may include a second binder 15 and a first set of pigments 13. In some examples, the ink receiving layer 14 may include a large pore volume and a lot of small size pores to absorb, for example, ink solvent to allow it to penetrate through the fusible layer 16. Accordingly, images may be formed with good color gamut, sharp line edge, good resolution, and the like. The ink receiving layer 14 may include a swellable ink receiving layer, a raw paper base, and the like. The ink receiving layer 14 may be formed by pond coating, Meyer rod coating, blade coating, air-knife coating, curtain coating, and the like.

Second Binder

In some examples, the second binder 15 may include at least one of polyvinyl alcohol, polyvinyl alcohol derivative, polyethylene glycol, polyethylene glycol derivative, polyurethane, polyvinylpyrrolidone, starch, starch derivative, gelatin, gelatin derivative, cellulose, cellulose derivative, maleic anhydride polymer, maleic anhydride copolymer, acrylic ester polymer, acrylic ester copolymer, polymethylacrylate, polymethylacrylate copolymer, polyacrylamide, and latex resin. The latex resin may be based on at least one of a polymer and a copolymer of styrene butadiene, acrylic, styrene acrylic, styrene methylacrylate, styrene acrylonitrile, styrene maleic anhydride, vinyl acrylic, vinyl acetate, vinyl ester, and vinyl ether.

First Set of Pigments

In some examples, the first set of pigments 13 of the ink receiving layer 14 may include at least one of fumed silica, colloidal silica, precipitated silica, silica gel, boehmite, alumina, titanium dioxide, precipitated calcium carbonate, grounded calcium carbonate, clay, and calcined clay. In some examples, the ink receiving layer 14 may be in the form of a coating.

Test Results

Below are examples of formulations of respective fusible layers of test samples of the recording medium illustrated in Table 1. In the formulations for examples 1-6, amounts are based on dry parts of each component and parts are based on weight. In the examples, the recording medium is formed by a plurality of layers including at least a base substrate, an ink receiving layer, and a fusible layer. The base substrate is an offset coated paper having about one hundred and fifty grams per square meter (gsm), provided by Sappi. The ink receiving layer 14 is a twenty two gsm of fume-silica coating applied on the base paper.

In the respective formulations listed in examples 1-6, chemicals are continually mixed together in a beaker for enough time until a homogeneous mix is obtained by using standard bench stirring equipment. The lacquers are then coated on a fume-silica coated inkjet paper by using an appropriate Meyer Rod to obtain a coat weight of two gsm. The prepared samples are then dried by a normal heat gun in a lab. The samples are printed on by a HP Photosmart PM2000e printer. Subsequently, a calendaring operation is provided to the printed samples in which the printed samples are passed through a lab calendering machine with a single nip. During the calendaring operation, the images on the printed samples are subjected to calendaring conditions including a combination of pressure of 3200 pounds per liner inch (pli) and temperature of 105° C. After the calendaring operation, the images are visually inspected for obvious image defects, such as bleeding, coalescence, area color fill, and the like. The scratch resistance of samples is evaluated on an Ink Durability Tester made by Rexsson Technology. A semi-stylus wood tip is used to scratch the image with 1.0 kg weight load for one cycle.

In Table 2 below, examples 1 through 6 correspond to the respective test samples of Table 1 in which images were printed thereon and subjected to visual and durability tests. Table 2 list the testing results of examples 1-6 and information of average particle size for the respective sets of polymeric beads in these samples. As illustrated in Table 2, respective samples with a fusible layer (not including a second set of polymeric beads), as identified in examples 1 and 4, may deliver AgX-level of gloss and distinctness of image (DOI). For example, the average gloss for an AgX sample is 74 gloss units (GU) measured at 20° and the average DOI of the same AgX sample is 3.7 GU. However, these respective samples achieved a lower scratch resistance level of 2 as compared to the AgX sample which achieved a scratch resistance of 8. The scratch resistance level is determined by providing a score from one to ten based on an evaluation on a level of ink removal and markers of the testing tip. On the scratch resistance scale of one to ten, for example, a scratch resistance score of 1 corresponds to a worst case in which inks of all colors have been removed or badly damaged and a scratch resistance score of ten corresponds to the best case in which the image remained undamaged and/or no marker was visible in the images. As illustrated in Table 2, when the fusible layer included a second set of polymeric beads combined with the first set of polymeric beads as identified in examples 3, 5 and 6, the scratch resistance level improved to at least close to the AgX level.

TABLE 1

Formulations for examples 1-6

| | Example #1 | Example #2 | Example #3 | Example #4 | Example #5 | Example #6 |
|---|---|---|---|---|---|---|
| Name of 1st set of polymeric beads | DPP 756A | DPP 756A | DPP 756A | RayCat 29033 | RayCat 29033 | RayCat 29033 |
| Amount of 1st set of polymeric beads | 100 parts | 80 parts | 80 parts | 100 parts | 100 parts | 100 parts |
| Name of 2nd set of polymeric beads | None | Slip Ayd SL300 | Hydrocer 257 | None | Slip Ayd SL300 | Ultralube D-816 |
| Amount of 2nd set of polymeric beads | 0 parts | 20 parts | 20 parts | 0 parts | 20 parts | 20 parts |
| Acronal S728 | 12 parts | 12 parts | 12.5 parts | 12 parts | 12 parts | 12 parts |
| Mowiol 40-88 | 0.5 parts | 0.5 parts | 0.5 parts | 0.5 parts | 0.5 parts | 0.5 parts |
| Tegowet 510 | 0.5 parts | 0.5 parts | 0.5 parts | 0.5 parts | 0.5 parts | 0.5 parts |

TABLE 2

Average particle size of the first and second set of polymeric beads and scratch resistant performance in examples 1-6

| | Example #1 | Example #2 | Example #3 | Example #4 | Example #5 | Example #6 |
|---|---|---|---|---|---|---|
| Name of 1st set of polymeric beads | DPP 756A | DPP 756A | DPP 756A | RayCat 29033 | RayCat 29033 | RayCat 29033 |
| Average particle size of 1st set of polymeric beads(μm) | 0.1-0.2 | 0.1-0.2 | 0.1-0.2 | 0.17 | 0.17 | 0.17 |
| Tg of 1st set of polymeric beads (° C.) | 92 | 92 | 92 | 77 | 77 | 77 |
| Name of 2nd set of polymeric beads | None | Slip Ayd SL300 | Hydrocer 257 | None | Slip Ayd SL300 | Ultralube D-816 |
| Average particle size of 2nd set of polymeric beads(μm) | 0 | 15-20 | 6.3 | 0 | 15-20 | 7 |
| Scratch resistance | 2 | 9 | 7 | 2 | 7 | 5 |
| Sheet gloss (20 degrees)(GU) | 58 | 54 | 40 | 65 | 39 | 81 |
| Average image gloss (20 degrees)(GU) | 92 | 105 | 82 | 105 | 97 | 102 |
| Average image DOI | 4.0 | 4.2 | 3.8 | 3.5 | 3.8 | 3.8 |

Figure 3:
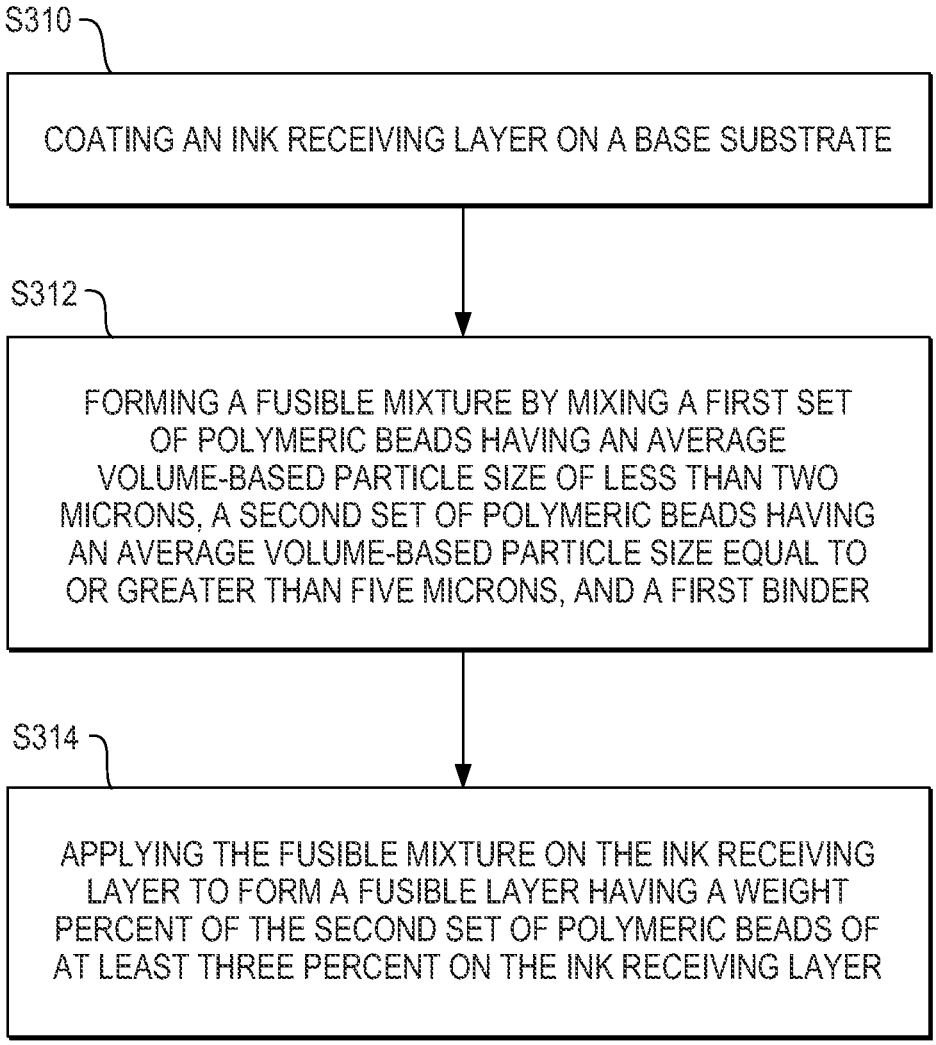
FIG. 3 is a flowchart illustrating a method of manufacturing a recording medium according to an example.

FIG. 3 is a flowchart illustrating a method of manufacturing a recording medium according to an example. Referring to FIG. 3, in block S310, an ink receiving layer is coated on a base substrate. In some examples, the coating an ink receiving layer on the base substrate may be performed by one of pond coating, Meyer rod coating, blade coating, air-knife coating, and curtain coating. In block S312, a fusible mixture is formed by mixing a first set of polymeric beads having an average volume-based particle size of less than two microns, a second set of polymeric beads having an average volume-based particle size equal to or greater than five microns, and a first binder. In some examples, the forming a fusible mixture may also include mixing the first set of polymeric beads, the second set of polymeric beads, and the first binder together to obtain a homogeneous mix. In block S314, the fusible mixture is applied on the ink receiving layer to form a fusible layer having a weight percent of the second set of polymeric beads of at least three percent on the ink receiving layer. In some examples, the applying the fusible mixture on the ink receiving layer may also include coating the fusible mixture on the ink receiving layer by at least one of pond coating, Meyer rod coating, blade coating, air-knife coating, curtain coating.

It is to be understood that the flowchart of FIG. 3 illustrates architecture, functionality, and/or operation of an example of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 3 illustrates a specific order of execution, the order of execution may differ from that which is depicted. For example, the order of execution of two or more blocks may be scrambled relative to the order illustrated. Also, two or more blocks illustrated in succession in FIG. 3 may be executed concurrently or with partial concurrence. All such variations are within the scope of the present disclosure.

The present disclosure has been described using non-limiting detailed descriptions of examples thereof and is not intended to limit the scope of the present disclosure. It should be understood that features and/or operations described with respect to one example may be used with other examples and that not all examples of the present disclosure have all of the features and/or operations illustrated in a particular figure or described with respect to one of the examples. Variations of examples described will occur to persons of the art. Furthermore, the terms "comprise," "include," "have" and their conjugates, shall mean, when used in the present disclosure and/or claims, "including but not necessarily limited to."

It is noted that some of the above described examples may include structure, acts or details of structures and acts that may not be essential to the present disclosure and are intended to be exemplary. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. A recording medium, comprising:

a base substrate;

a fusible layer including a first set of polymeric beads and a second set of polymeric beads;

the first set of polymeric beads having an average volume-based particle size less than two microns; and the second set of polymeric beads having an average volume-based particle size equal to or greater than five microns; and an ink receiving layer disposed between the base substrate and the fusible layer; and wherein the fusible layer includes a weight percent of the second set of polymeric beads of at least three percent.

2. The recording medium according to claim 1, wherein the fusible layer further comprises:

a binder, the binder including at least one of polyvinyl alcohol, polyvinyl alcohol derivative, polyethylene glycol, polyethylene glycol derivative, polyurethane, polyvinylpyrrolidone, starch, starch derivative, gelatin, gelatin derivative, cellulose, cellulose derivative, maleic anhydride polymer, maleic anhydride copolymer, acrylic ester polymer, acrylic ester copolymer, polymethylacrylate, polymethylacrylate copolymer, polyacrylamide, and latex resin.

3. The recording medium according to claim 1, wherein the first set of polymeric beads further comprises at least one of solid beads and hollow beads.

4. The recording medium according to claim 1, wherein the first set of polymeric beads further comprises at least one of:

a synthetic polymer including at least one of at least one of polyethylene, polypropylene, paraffin, polybutadiene, polyurethane, epoxy resin, silicone resin, polyamide resin, styrene, styrene butadiene, styrene acrylate, styrene acrylic, ester, acrylic, acrylate, methylacrylate, vinyl ester, vinyl ether, and vinyl ketone; and a natural polymer including natural wax, gelatin, gelatin derivative, cellulose, cellulose derivative, starch, and starch derivative.

5. The recording medium according to claim 4, wherein the first set of beads is in at least one of a dispersion form and a latex form.

6. The recording medium according to claim 1, wherein the second set of polymeric beads further comprises at least one of:

a synthetic polymer including at least one of at least one of polyethylene, polypropylene, paraffin, polybutadiene, polyurethane, epoxy resin, silicone resin, polyamide resin, styrene, styrene butadiene, styrene acrylate, styrene acrylic, ester, acrylic, acrylate, methylacrylate, vinyl ester, vinyl ether, and vinyl ketone; and a natural polymer including natural wax, gelatin, gelatin derivative, cellulose, cellulose derivative, starch, and starch derivative.

7. The recording medium according to claim 6, wherein the second set of polymeric beads is in at least one of a dispersion form and a latex form.

8. The recording medium according to claim 1, wherein the first set of polymeric beads and the second set of polymeric beads further comprise:

a glass transition temperature in a range of fifty ° C. to two hundred fifty ° C.

9. The recording medium according to claim 1, wherein the first set of polymeric beads and the second set of polymeric beads further comprise:

a glass transition temperature in a range of eighty ° C. to two hundred ° C.

10. The recording medium according to claim 1, wherein the average volume-based particle size of the first set of polymeric beads is less than one micron.

11. The recording medium according to claim 1, wherein the average volume-based particle size of the second set of polymeric beads is greater than eight microns.

12. The recording medium according to claim 1, wherein an amount of the first set of polymeric beads is greater than an amount of the second set of polymeric beads in the fusible layer.

13. The recording medium according to claim 1, wherein the ink receiving layer further comprises:

a set of pigments;

a first binder; and a second binder.

14. The recording medium according to claim 13, wherein the set of pigments of the ink receiving layer comprises at least one of fumed silica, colloidal silica, precipitated silica, silica gel, boehmite, alumina, titanium dioxide, precipitated calcium carbonate, grounded calcium carbonate, clay, and calcined clay.

15. The recording medium according to claim 14, wherein the second binder comprises at least one of polyvinyl alcohol, polyvinyl alcohol derivative, polyethylene glycol, polyethylene glycol derivative, polyurethane, polyvinylpyrrolidone, starch, starch derivative, gelatin, gelatin derivative, cellulose, cellulose derivative, maleic anhydride polymer, maleic anhydride copolymer, acrylic ester polymer, acrylic ester copolymer, polymethylacrylate , polymethylacrylate copolymer, polyacrylamide, and latex resin.

16. A recording medium, comprising:

a base substrate;

a fusible layer including a first set of polymeric beads, a second set of polymeric beads, and a first binder;

the first set of polymeric beads having an average volume-based particle size less than two microns and a glass transition temperature in a range of fifty ° C. to two hundred fifty ° C., and an amount of the first set of polymeric beads is greater than an amount of the second set of polymeric beads in the fusible layer; and the second set of polymeric beads having an average volume-based particle size equal to or greater than five microns, and a glass transition temperature in a range of fifty ° C. to two hundred fifty ° C.; and an ink receiving layer disposed between the base substrate and the fusible; and wherein the fusible layer includes a weight percent of the second set of polymeric beads of at least three percent.

17. A method of manufacturing a recording medium, the method comprising:

coating an ink receiving layer on a base substrate;

forming a fusible mixture by mixing a first set of polymeric beads having an average volume-based particle size of less than two microns, a second set of polymeric beads having an average volume-based particle size equal to or greater than five microns, and a first binder; and applying the fusible mixture on the ink receiving layer to form a fusible layer having a weight percent of the second set of polymeric beads of at least three percent on the ink receiving layer.

18. The method according to claim 17, wherein the coating an ink receiving layer on the base substrate is performed by one of pond coating, Meyer rod coating, blade coating, air-knife coating, and curtain coating.

19. The method according to claim 17, wherein the forming a fusible mixture further comprises:

mixing the first set of polymeric beads, the second set of polymeric beads, and the first binder together to obtain a homogeneous mix.

20. The method according to claim 17, wherein the applying the fusible mixture on the ink receiving layer further comprises:

coating the fusible mixture on the ink receiving layer by one of pond coating, Meyer rod coating, blade coating, air-knife coating, and a curtain coating.

21. The recording medium according to claim 1, wherein the first set of polymeric beads consists of hollow beads.

22. The recording medium according to claim 16, wherein the glass transition temperatures of the first set of polymeric beads and the second set of polymeric beads are different temperatures.

23. The recording medium according to claim 1, wherein the first set of polymeric beads has a shape selected from the group consisting of a spherical shape, an irregular shape, or a combination thereof.

* * * * *

UNITED STATES PATENT AND TRADEMARK OFFICE

CERTIFICATE OF CORRECTION

PATENT NO. : 8,652,595 B2
APPLICATION NO. : 13/424129
DATED : February 18, 2014
INVENTOR(S) : Zeng et al.

It is certified that error appears in the above-identified patent and that said Letters Patent is hereby corrected as shown below:

In the Claims

Column 10, line 25, Claim 4, after “including” delete “at least one of”.

Column 10, line 40, Claim 6, after “including” delete “at least one of”.

Column 11, line 23, Claim 15, delete “polymethylacrylate ,” and
insert -- polymethylacrylate, --, therefor.

Signed and Sealed this
Sixteenth Day of September, 2014

Michelle K. Lee

Michelle K. Lee
*Deputy Director of the United States Patent and Trademark Office*